US006535613B1

(12) United States Patent
Ssutu

(10) Patent No.: US 6,535,613 B1
(45) Date of Patent: Mar. 18, 2003

(54) AIR FLOW CONTROL DEVICE FOR LOUDSPEAKER

(75) Inventor: Jason A. Ssutu, Davie, FL (US)

(73) Assignee: JL Audio, Inc., Miramar, FL (US)

( * ) Notice: Subject to any disclaimer, the term of this patent is extended or adjusted under 35 U.S.C. 154(b) by 0 days.

(21) Appl. No.: 09/473,895

(22) Filed: Dec. 28, 1999

(51) Int. Cl.[7] ..... H04R 25/00

(52) U.S. Cl. ..... 381/397; 381/412; 381/419; 381/420

(58) Field of Search ..... 381/397, 411, 381/412, 419, 420, 386, 410, 159, 154, 380

(56) References Cited

U.S. PATENT DOCUMENTS

| | | | | |
|---|---|---|---|---|
| 1,759,725 | A | 5/1930 | Young et al. | |
| 1,869,665 | A | 8/1932 | Chann | |
| 1,915,217 | A | 6/1933 | Crosley, Jr. | |
| 2,038,401 | A | 4/1936 | Wunderlich | 179/115.5 |
| 2,261,110 | A | 11/1941 | Engholm | 179/115.5 |
| 2,261,111 | A | 11/1941 | Engholm | 179/115.5 |
| 2,295,483 | A | 9/1942 | Knowles | 179/115.5 |
| 2,429,470 | A | 10/1947 | Knowles | 179/115.5 |
| 2,775,309 | A | 12/1956 | Willchur | 181/31 |
| 2,858,377 | A | 10/1958 | Levy | 179/115.5 |
| 3,328,537 | A | 6/1967 | Hecht | 179/115.5 |
| 3,991,286 | A | 11/1976 | Henricksen | 179/115.5 H |
| 4,158,756 | A | 6/1979 | Keezer | 179/115.5 R |
| 4,210,778 | A | 7/1980 | Sakurai et al. | 179/1 E |
| 4,313,040 | A | 1/1982 | Tsukamoto | 179/115.5 R |
| 4,387,275 | A | 6/1983 | shimada et al. | 179/115.5 R |
| 4,418,247 | A | 11/1983 | Hansen | 179/115.5 R |
| 4,433,214 | A | 2/1984 | Jasinski | 179/115.5 ES |
| 4,437,297 | A | 3/1984 | Kawamura | 179/117 |
| 4,547,632 | A | 10/1985 | Bryson | 179/115.5 VC |
| 4,577,069 | A | 3/1986 | Keezer | 179/119 R |
| 4,590,332 | A | 5/1986 | Delbuck | 179/115.5 PS |
| 4,821,331 | A | 4/1989 | Murayama et al. | 381/192 |
| 4,933,975 | A | 6/1990 | Button | 381/192 |
| 5,042,072 | A | 8/1991 | Button | 381/192 |
| 5,081,684 | A | 1/1992 | House | 381/199 |
| 5,357,586 | A | 10/1994 | Nordschow et al. | 381/199 |
| 5,426,707 | A | 6/1995 | Wijnker | 381/194 |
| 5,430,804 | A | 7/1995 | Wijinker | 381/194 |
| 5,909,015 | A | 6/1999 | Yamamoto et al. | 181/156 |
| 5,940,522 | A | 8/1999 | Cahill et al. | 381/397 |

FOREIGN PATENT DOCUMENTS

| | | |
|---|---|---|
| AU | 0 542 761 | 5/1988 |
| DE | 900 227 | 12/1953 |
| FR | 2 440 227 | 5/1980 |
| GB | 724113 | 3/1952 |
| JP | 3-239099 | 10/1991 |

*Primary Examiner*—Rexford Barnie
*Assistant Examiner*—Dionne Harvey
(74) *Attorney, Agent, or Firm*—Holland & Knight LLP

(57) ABSTRACT

An air flow control device is positioned relative to the throughbore in the pole piece of the motor structure of a speaker, such that the flow of air entering and leaving a cavity overlying the voice coil and pole piece is directed along a flow path which passes in thermal communication with at least a portion of the interior surface of the former of the voice coil opposite the wire winding on the exterior surface of the former.

24 Claims, 5 Drawing Sheets

AIR FLOW CONTROL DEVICE FOR LOUDSPEAKER

FIELD OF THE INVENTION

This invention relates to loudspeakers, and, more particularly, to alternative embodiments of an air flow control device which is located with respect to the throughbore in the pole piece of the motor of the speaker to direct cooling air, flowing in and out of the cavity located between the voice coil and dust cap and diaphragm, along a flow path in thermal communication with the interior surface of the voice coil of the speaker.

BACKGROUND OF THE INVENTION

Loudspeakers generally comprise a frame, a motor structure, a diaphragm, a lower suspension or spider and a surround. In one common type of speaker, the motor structure includes a permanent magnet mounted between a top plate and a back plate, a pole piece centrally mounted on the back plate and a voice coil axially movable with respect to the pole piece. The voice coil includes a hollow, cylindrical-shaped former having an outer surface which receives a winding of wire.

One end of the diaphragm is connected to the surround or upper suspension, which, in turn, is mounted to the upper end of the frame. The lower suspension or spider is connected at one end to a seat formed in the frame at a point between its upper and lower ends. The free ends of the diaphragm and spider are mounted to the voice coil and support it within the air gap between the pole piece and top plate of the motor structure, with the former of the voice coil concentrically disposed about the pole piece. In some speaker designs, a dust cap is mounted to the diaphragm in position to overlie the voice coil and pole piece to protect them from contaminants. This forms a dust cap cavity between the dust cap, diaphragm, the voice coil and pole piece. In alternative designs, the upper end of the voice coil is connected directly to the diaphragm, thus eliminating the need for a dust cap but nevertheless forming an internal or dust cap cavity in the area directly above the voice coil and pole piece.

In the course of operation of a speaker of the type described above, electrical energy is supplied to the voice coil causing it to axially move relative to the pole piece and within the air gap formed between the top plate and pole piece. The diaphragm, spider and surround, move with the excursion of the voice coil. A pervasive problem associated with speaker operation involves the build up of heat produced by the voice coil and radiated to surrounding surfaces, particularly the top plate. Both the voice coil and top plate become quite hot during speaker operation which can reduce the power handling of the speaker, and increase power compression, i.e. a reduction in acoustic output due to temperature-related voice coil resistance.

A variety of designs have been employed in the prior art to address the problems associated with heat build up in speakers. One approach has been to create a flow of cooling air in thermal communication with the voice coil, such as disclosed, for example, in U.S. Pat. No. 5,042,072 to Button, U.S. Pat. No. 5,357,586 to Nordschow et al. and U.S. Pat. No. 5,426,707 to Wijnker. Speaker designs of this type generally include a pole piece formed with passages which provide a flow path for the transfer of cooling air from outside of the speaker into and out of the dust cap cavity described above. An air flow through these passages is created in response to movement of the diaphragm with the excursion of the voice coil. When the diaphragm moves in one direction, air is drawn from outside of the speaker, along the passages in or along the pole piece, and then into the dust cap cavity. Movement of the diaphragm in the opposite direction creates a flow out of the cavity along the reverse flow path.

In the Button U.S. Pat. No. 5,042,072, the pole piece of the motor is formed with a series of circumferentially spaced, longitudinally extending grooves or channels. Each channel extends radially inwardly from the outer surface of the pole piece toward its center, and from the top end of the pole piece to its bottom end including in the area of the air gap between the pole piece and top plate. The purpose of the radial channels in the pole piece is to direct a flow of air along the voice coil as the air passes in and out of the dust cap cavity. Although it is contemplated that at least some of the air flow contacts the voice coil in this design, because the radial channels in the pole piece are oriented parallel to the voice coil along the longitudinal axis of the pole piece a limited amount of the cooling air actually impinges directly against the voice coil. Additionally, the formation of a number of radial channels in the pole piece reduces its mass in the area of the air gap with the top plate. This increases the reluctance of the magnetic path between the pole piece and top plate resulting in a decrease in motor strength which can adversely impact the acoustic performance of the speaker.

U.S. Pat. No. 5,357,586 to Nordschow employs a pole piece including a central throughbore forming an annular wall defining a hollow interior. An aerodynamically-shaped insert is mounted within the central bore of the pole piece by a series of fins or spacers, thus forming longitudinally extending channels between the insert and the wall. Additionally, the wall of the pole piece is formed with a number of transverse bores extending between its outer surface and the central bore. In response to movement of the voice coil and diaphragm in one direction, air from outside of the speaker is drawn into the central bore of the pole piece, through its transverse bores, along the exterior surface of the pole piece into the air gap between the pole piece and top plate, and then through bores formed in the voice coil into the dust cap cavity. Movement of the diaphragm in the reverse direction causes a flow of air out of the cavity through the voice coil bores, and then predominantly through the central bore of the pole piece along the channels formed by the fins of the aerodynamically-shaped insert.

Although the intention in the '586 patent is to cool the voice coil, it is unlikely that any effective cooling would occur with this design. The air gap between the pole piece and top plate is exceedingly small, particularly considering that the voice coil is located therein, and no appreciable amount of air flow can be created through the air gap without using a design such as described in the '072 Button patent wherein longitudinal channels are formed in the pole piece to provide a flow path between the pole piece and the top plate. The '586 patent does not include a pole piece with longitudinal channels along its exterior surface, but instead attempts to force a flow of air from the transverse bores in the pole piece through the air gap, and, hence, along the outer surface of the voice coil. Additionally, the flow of air in the reverse direction noted above is for venting purposes only and does not result in the movement of cooling air along or adjacent to the wire winding of the voice coil.

The '707 patent to Wijnker is similar to Nordschow et al. in that it includes in one embodiment a pole piece formed with a central bore and a number of transverse bores extending through the wall of the pole piece. The transverse bores in Wijnker are employed to create a flow of air from outside of the speaker, into the central bore of the pole piece and then out the transverse bores to discharge ports formed in the back plate of the speaker. No cooling air passes from the transverse bores, along the voice coil and into and out of the dust cap cavity. Alternative embodiments of Wijnker disclose a flow path into and out of the dust cap cavity, but employ a pole piece formed with a throughbore and no transverse bores and wherein an attempt is made, as in Nordschow et al., to force air to flow within the air gap between the top plate and pole piece.

SUMMARY OF THE INVENTION

It is therefore among the objectives of this invention to provide an air flow control device for use with a loudspeaker which effectively cools at least a portion of the voice coil, which is simple and inexpensive to construct, which avoids interference between the voice coil and motor during excursions of the voice coil and which can be employed with loudspeakers of conventional design.

These objectives are accomplished in an air flow control device insertable within the throughbore of the pole piece in the motor structure of the speaker, or affixed to the pole piece in position over the upper end of its throughbore, which functions to direct the flow of air entering and leaving the dust cap cavity along a flow path which passes in thermal communication with at least a portion of the interior surface of the former of the voice coil opposite the wire winding on the exterior surface of the former.

This invention is predicated upon the concept of redirecting the flow of cooling air produced in conventional speaker designs. As noted above, in response to axial movement of the voice coil in one direction, the diaphragm moves axially thus inducing a flow of air from outside of the speaker, through the throughbore in the pole piece and then into the dust cap cavity. Movement of the diaphragm in the opposite direction forces air within the dust cap cavity to move in the reverse direction along the same flow path, through the pole piece and outside of the speaker. In conventional designs, this cooling air flows through the hollow former, but does not pass directly against the area of the former which mounts the winding. The purpose of the air flow control devices of this invention is to divert or re-direct this air flow so that it passes directly against at least a portion of the interior surface of the former opposite the area where the wire winding of the voice coil is mounted.

In one presently preferred embodiment, the air flow control device comprises a head portion connected to a body portion having a throughbore and at least one transverse bore perpendicular to the throughbore. The body portion of the flow control device is inserted into the throughbore in the pole piece so the head portion, and at least one transverse bore, are located externally of the pole piece. The diameter of the head portion of the flow control device is somewhat smaller than the internal diameter of the cylindrical-shaped former of the voice coil so that in the course of movement of cooling air into and out of the dust cap cavity, as described above, the air is deflected by the head portion of the air flow control device against the inner surface of the former. Such air flow passes through the transverse bores, and the throughbore of the air flow control device, in the course of movement between the dust cap cavity and the throughbore of the pole piece.

Alternative embodiments of air flow control devices according to this invention operate in essentially the same fashion. In one version, a head portion with external grooves is connected to a body portion having circumferentially spaced vanes forming channels therebetween. In still another version, the same body is employed but with a head portion in the shape of a circular plate. The body portion of each of these air flow control devices is inserted within the throughbore of the pole piece such that the head portion, and at least part of the vanes in the body portion, are located externally of the pole piece. The channels within the body portion permit the passage of air through the pole piece, and the head portion of each embodiment is effective to direct the air flow entering and leaving the dust cap cavity, and the throughbore of the pole piece, against the interior surface of the former of the voice coil.

In still another embodiment of this invention, a cap is provided which resembles a cup having a hollow interior, a base and a cylindrical side wall. A number of spaced ribs or stand offs are mounted to the base of the cap, which, in turn, are affixed to the upper end of the pole piece directly over its throughbore. Each space between adjacent stand offs forms a passage which is oriented to direct the air flowing in and out of the dust cap cavity against the interior surface of the former, in a manner similar to the other embodiments of this invention.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
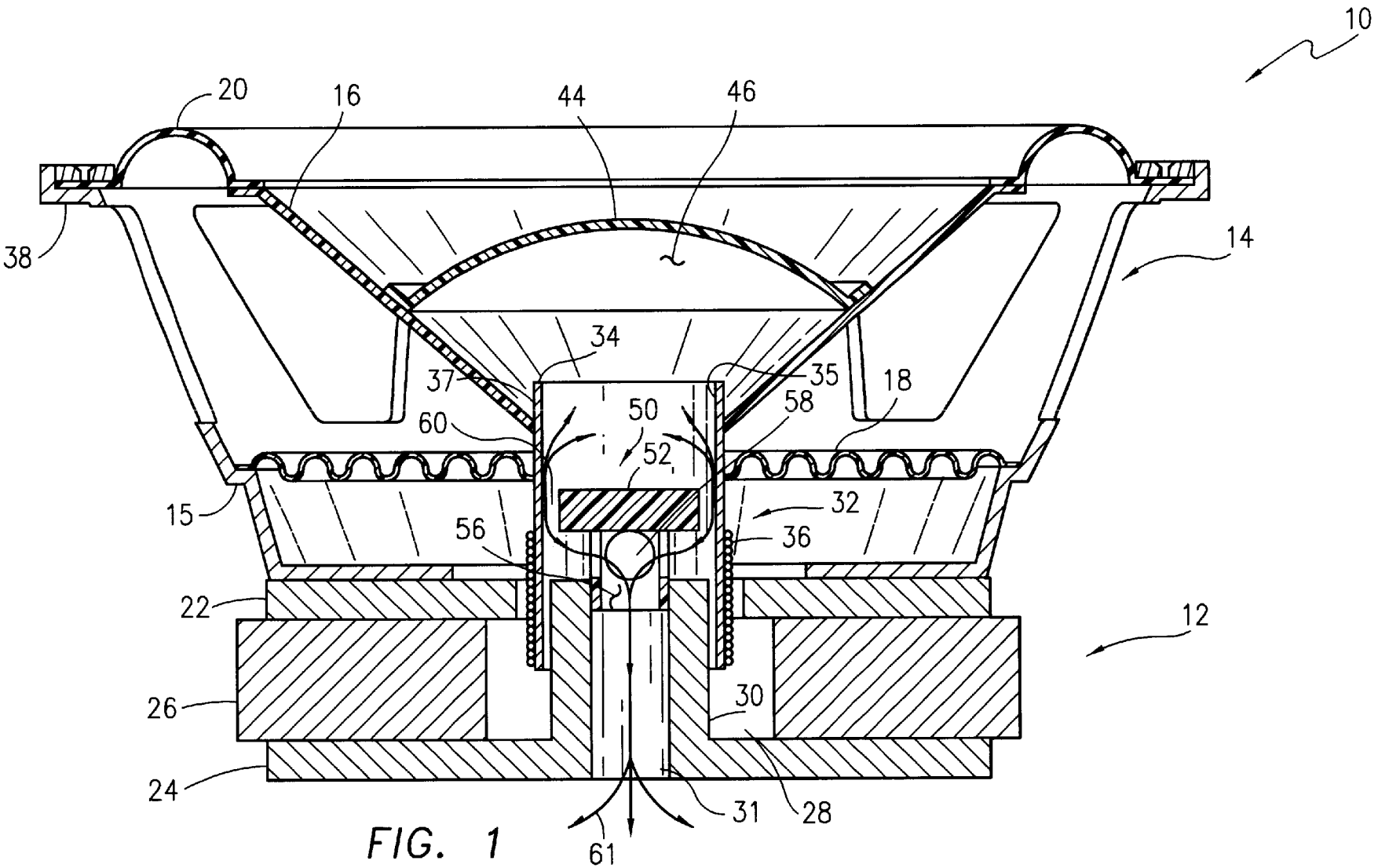
FIG. 1 is an elevational view, in partial cross section, of a speaker having one embodiment of the flow control device of this invention.
Figure 2:
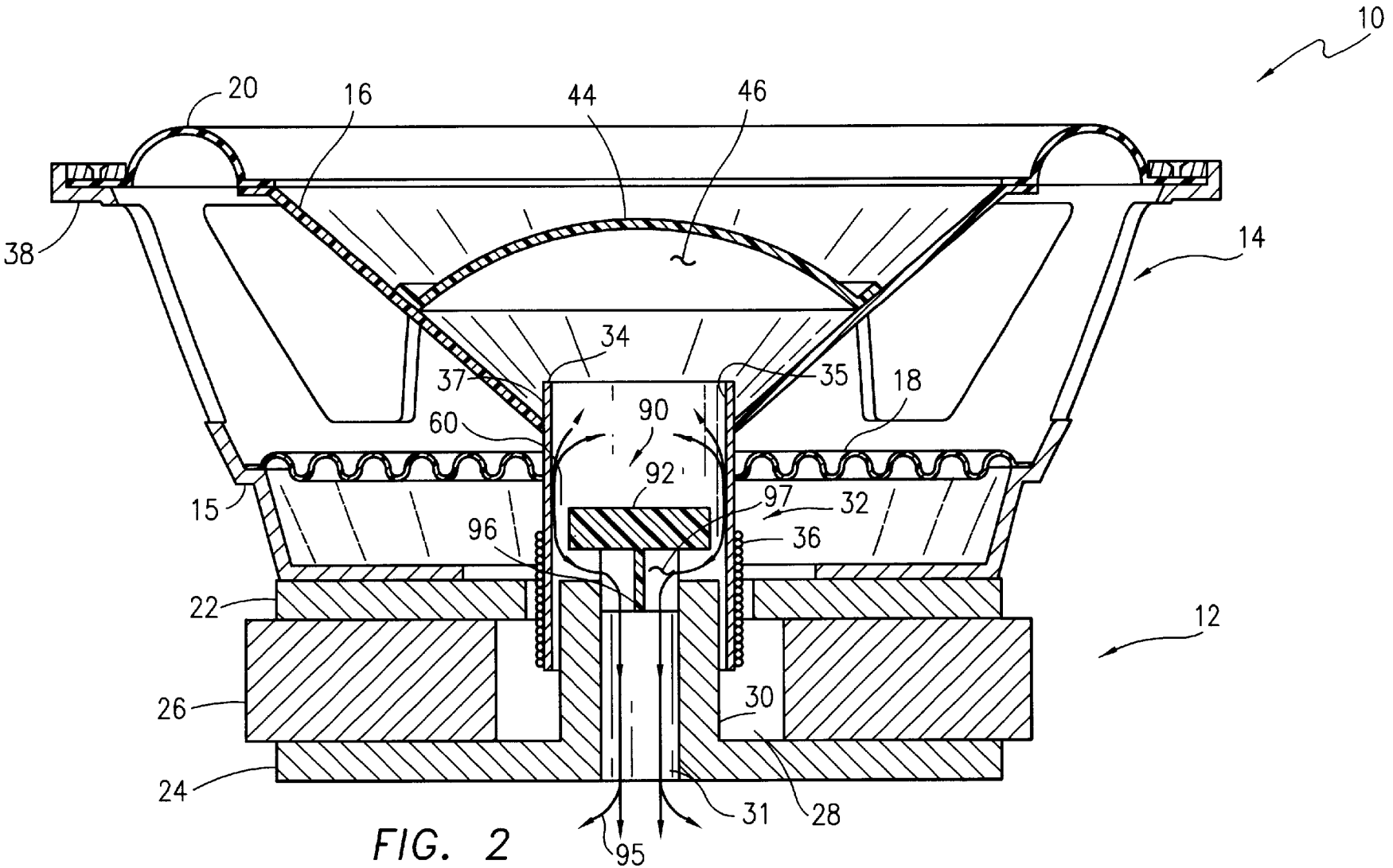
FIG. 2 is a view similar to FIG. 1, but with an alternative embodiment of the flow control device herein.
Figure 3:
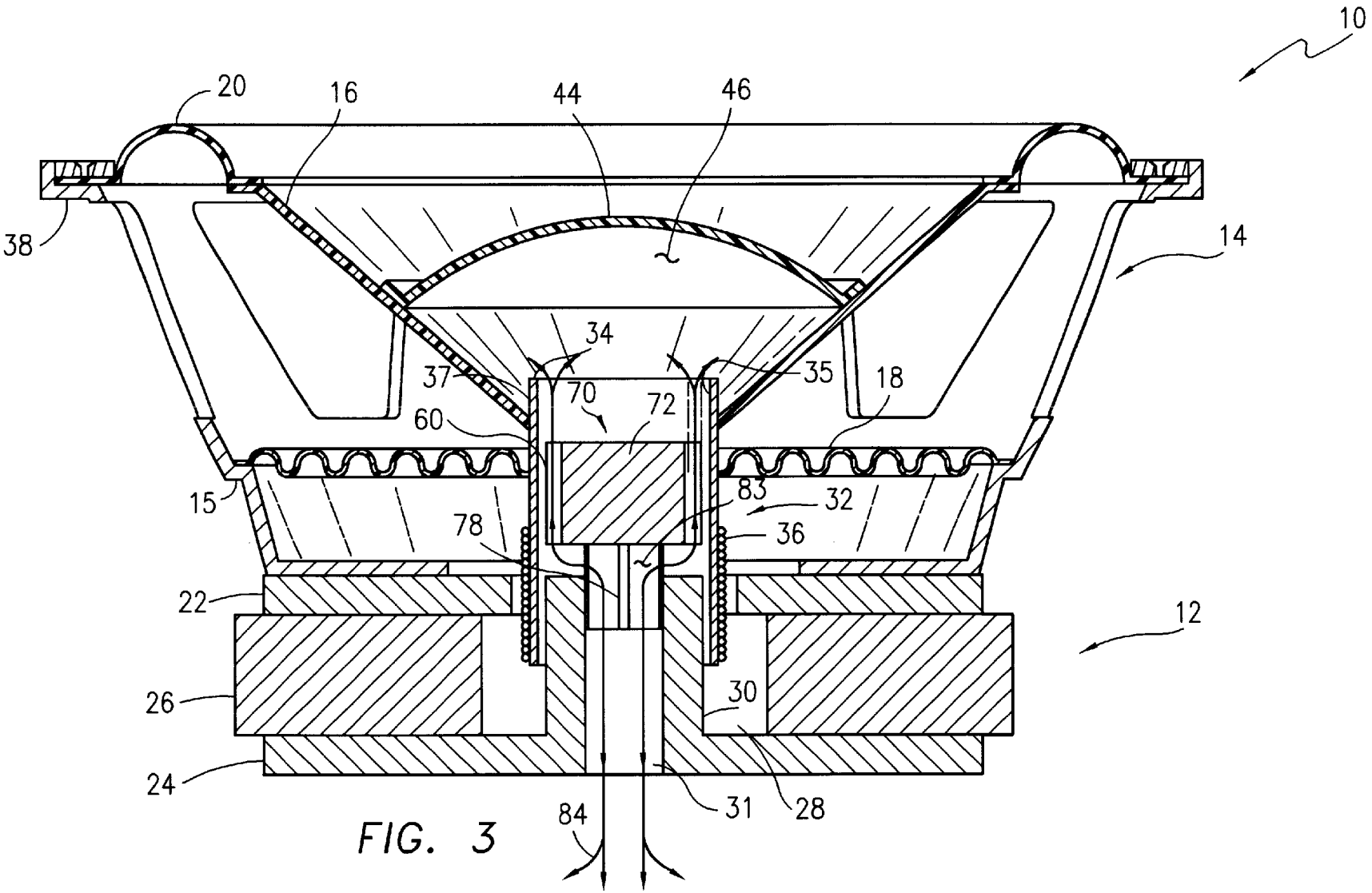
FIG. 3 is a view similar to FIGS. 1 and 2, including a still further embodiment of the flow control device.

Referring initially to FIGS. 1–3, a loudspeaker 10 is illustrated which is identical in each of such Figs. except for the inclusion of different air flow control devices, described in detail below. Although the detailed construction of the speaker 10 forms no part of this invention, for purposes of the present discussion it is briefly described as follows.

The speaker 10 generally comprises a motor structure 12, a frame 14 mounted to the motor structure 12, a diaphragm 16, a lower suspension or spider 18 and an upper suspension or surround 20. Conventionally, the motor structure 12 includes a top plate 22 and a back plate 24 which are spaced from one another and mount a permanent magnet 26 therebetween. A pole piece 30 is integrally formed with and extends upwardly from the back plate 24 into a central bore 28 formed in both the magnet 26 and top plate 22. An air gap is formed between the top plate 22 and the pole piece 30, as shown. A voice coil 32 is also provided which includes a hollow, cylindrical-shaped former 34 having an inner surface 35 and an outer surface 37 which receives a wire winding 36. The former 34 is concentrically disposed about the pole piece 30, and the voice coil 32 is axially movable within the air gap during operation of the speaker 10.

The voice coil 32 is held in place with respect to the pole piece 30 by the diaphragm 16, spider 18 and surround 20. One end of the diaphragm 16 is affixed to the former 34 by adhesive or the like, and its opposite end connects to the surround 20. The surround 20, in turn, is mounted to the upper end 38 of the frame 14 as shown. The diaphragm 16 and surround 20 collectively provide support for the voice coil 32, in addition to the lower suspension or spider 18. As shown in the Figs., one end of the spider 18 connects to the former 34, and its opposite end mounts to a seat 15 formed in the frame 14.

A dust cap 44 is mounted to the diaphragm 16 in position to overlie the voice coil 32 and pole piece 30 in order to protect such elements from dirt, dust and other contaminants. A dust cap cavity 46 is therefore formed in the area defined by the lower portion of the diaphragm 16, the dust cap 44, the voice coil 32 and the pole piece 30. In response to the input of electrical energy to the wire winding 36, the voice coil 32 is moved axially with respect to the fixed motor structure 12. Because the diaphragm 16, spider 18, surround 20 and dust cap 44 are operatively connected to the former 34, such elements also move with the excursion of the voice coil 32. A "pumping" action is created as a result of axial movement of the diaphragm 16 and dust cap 44, which creates a flow of air from outside of the speaker 10 into and out of the cavity 46.

Figure 4:
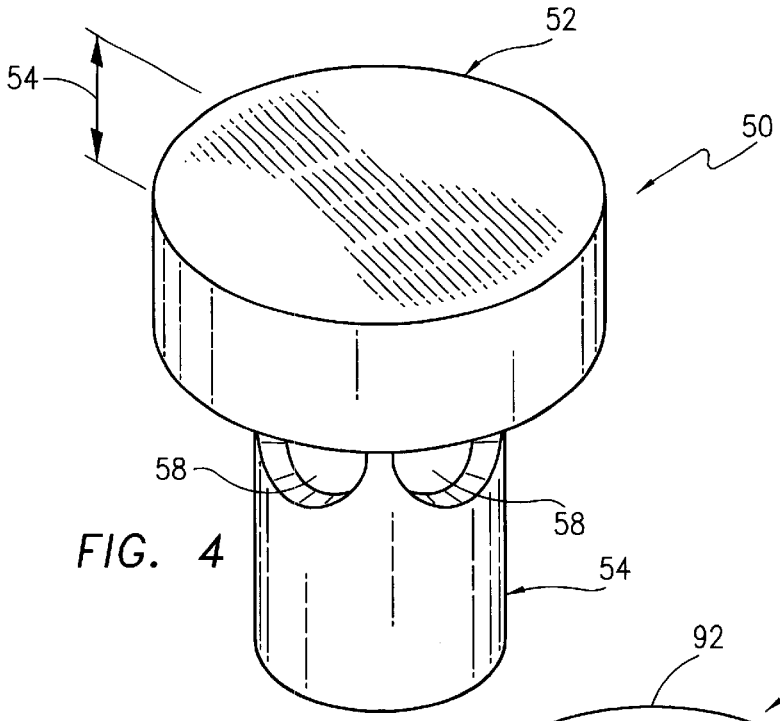
FIGS. 4–6 are perspective views of the flow control devices depicted in FIGS. 1–3, respectively.

The purpose of the air flow control devices of this invention is to direct the flow of cooling air described above against the interior surface 35 of the former 34, and, indirectly, against the wire winding 36 carried on the opposite external surface 37 of the former 34. With reference to FIGS. 1 and 4, one air flow control device 50 comprises a head portion 52 in the form of a circular plate which is connected to a body portion 54. The body portion 54 includes a central bore 56 which is intersected by a number of transverse bores 58 formed in the body portion 54 at a location proximate the head portion 52. The body portion 54 of device 50 is inserted within the throughbore 31 of pole piece 30 so that the head portion 52 and the transverse bores 58 are located externally of the pole piece 30.

The diameter of the head portion 52 of the flow control device 50 is somewhat smaller than the internal diameter of the former 34 of the voice coil 30 creating a gap 60 therebetween. The flow of air entering and leaving the cavity 46, as described above and depicted by arrows 61 in FIG. 1, is deflected by the head portion 52 of device 50 against the interior surface 35 of the former 34 opposite the wire winding 36 on its exterior surface 37 as the air flows through the gap 60. Due to the comparatively small cross sectional area of the gap 60, the velocity of the air flowing therethrough is accelerated thus enhancing the cooling effect of the air as it moves past the area of the former 34 carrying at least a portion of the wire winding 36.

Figure 5:
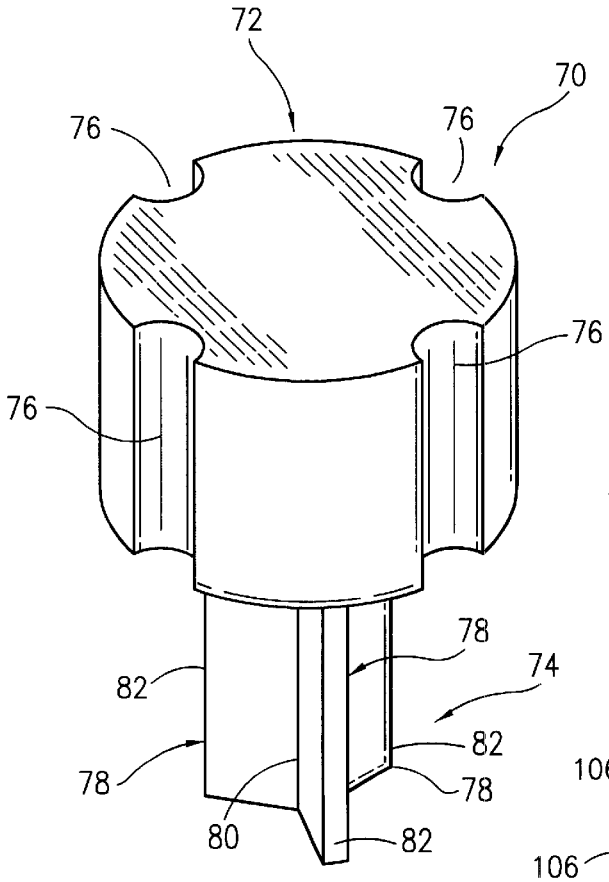
Figure 6:
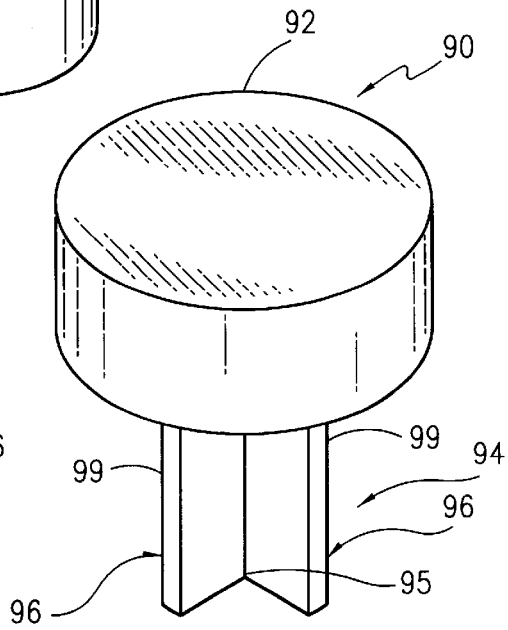

The embodiments of the air flow control devices depicted in FIGS. 5 and 6 function in a similar manner to device 50. With reference to FIGS. 3 and 5, an air flow control device 70 is illustrated which includes a head portion 72 connected to a body portion 74. The head portion 72 has an outer surface and a number of radially inwardly extending grooves 76 which are spaced from one another. The body portion 74 consists of a number of ribs or vanes 78 each having an inner edge 80 and an outer edge 82. The inner edges 80 of the vanes 78 are interconnected, and they extend radially outwardly from one another forming channels 83 between adjacent vanes 78. See FIG. 3. The body portion 74 of device 70 is inserted within the throughbore 31 of pole piece 30 so that the outer edge 82 of each vane 78 engages the pole piece 30 and the head portion 72 is located externally of the throughbore 31. The diameter of the head portion 72 is slightly less than the internal diameter of the voice coil former 34 forming a gap 60 therebetween. In response to movement of the voice coil 32 and diaphragm 16, a flow of air from outside of the speaker 10 enters the pole piece throughbore 31 and flows along the channels 83 in the flow control device 70. As depicted by the arrows 84 in FIG. 3, the air flow from channels 83 contacts the head portion 72 of device 70 and is directed along the interior surface 35 of the voice coil former 34 in the course of movement within the grooves 76 in the head portion 72 through the gap 60 into the dust cap cavity 46. Movement of the diaphragm 16 in the opposite direction includes a flow of air out of the dust cap cavity 46 along the reverse flow path.

The air flow control device 90 depicted in FIGS. 2 and 6 is similar to device 70. In this embodiment, a head portion 92 in the form of a circular plate is connected to a body portion 94 having a number of vanes 96 which are interconnected at an inner edge 95 thereof and extend radially outwardly from one another forming channels 97 between adjacent vanes 96. The body portion device 94 of the device 90 is inserted into the throughbore 31 of the pole piece 30 so that the head portion 92 and part of the length of the vanes 96 are located externally of the pole piece 30, and the outer edge 99 of each vane 96 contacts the internal wall of the pole piece 30. The air flow control device 90 operates in essentially the same manner as devices 50 and 70. The air flow through the pole piece 30 and the channels 97 of body portion 94, depicted by arrows 95, is deflected by the head portion 92 of air flow control device 90 into engagement with, or at least close proximity to, the interior surface 35 of the former 34 opposite the wire winding 36. In the presently preferred embodiments, the head portions 72 and 92 of air flow control devices 70 and 90, respectively, have a diameter which is essentially the same as that of head portion 52 of device 50 to accelerate the flow of cooling air flowing through gap 60 as a described above.

Figure 8:
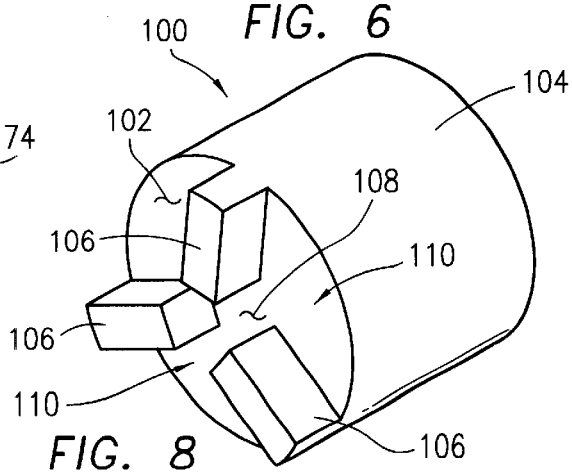
FIG. 8 is a perspective bottom view of the air flow control device shown in FIG. 7.
Figure 7:
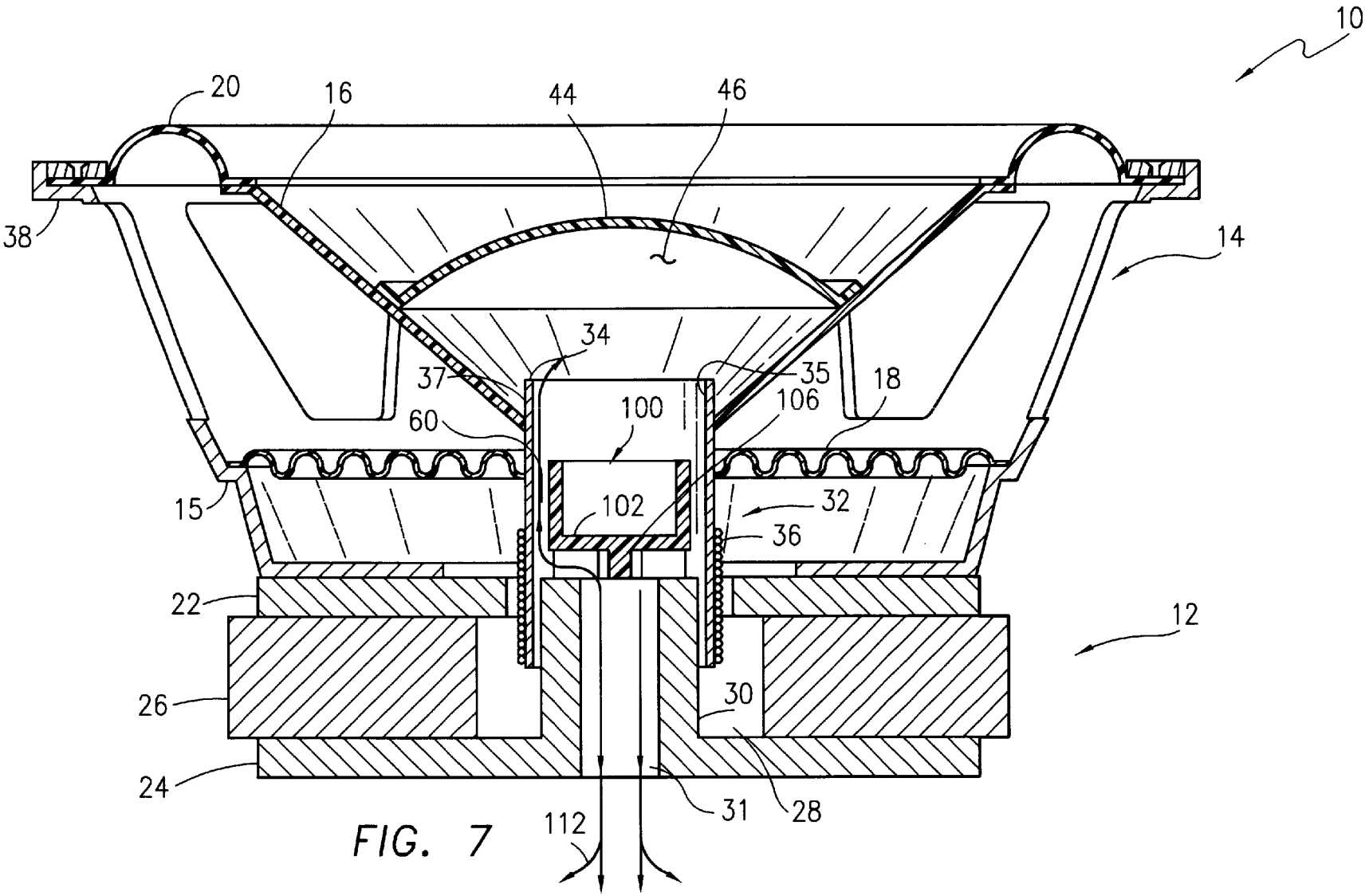
FIG. 7 is an elevational view, in partial cross section, of a speaker having an alternative flow control device mounted over the throughbore of the pole piece.

Referring now to FIGS. 7 and 8, an alternative embodiment of this invention is illustrated. Unlike the previous embodiments, an air flow control device 100 is provided which overlies the throughbore 31 of the pole piece 30 instead of being inserted therein. The flow control device 100 is generally cup-shaped having a base 102 connected to a cylindrical wall 104 forming a hollow interior. A number of ribs 106 are mounted to the base 102 which extend radially outwardly from an open center area 108 to the outer edge of the base 102. The ribs 106 are circumferentially spaced from on another forming passages 110 in between. Each rib 106 is affixed to the upper end of the pole piece 30 by adhesive or other suitable means of attachment so that the center area 108 aligns with the pole piece throughbore 31, and the base 102 of the flow control device 100 is spaced vertically above the pole piece 30 in the orientation of the speaker 10 shown in FIG. 7. A gap 60, as in the previously described embodiments, is formed between the interior surface 35 of the voice coil former 34 and the base 102 and wall 104 of the flow control device 100.

The operation of the embodiment of FIGS. 7 and 8 is essentially the same as described above in connection with the other embodiments of this invention. Air entering the throughbore 31 of pole piece 30 in response to excursion of the voice coil 32 and diaphragm 16 contacts the base 102 of the flow control device 100 and moves along the passages 110 between adjacent ribs 106 into direct contact with the interior surface 35 of the former 34 of the voice coil 32 opposite the wire winding 36. See arrows 112. The air continues moving along the gap 60 into the dust cap cavity 46, and then reverses direction along the same flow path upon movement of the diaphragm 16 in the opposite direction.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the speaker 10 of this invention is illustrated with a dust cap 44 connected to the diaphragm 16 in position overlying the voice coil 32 and pole piece 30. In this construction, the dust cap cavity 46 is formed by the diaphragm 16, dust cap 44, voice coil 32 and pole piece 30. It is also contemplated that the dust cap 44 could be removed, and the diaphragm 16 directly connected to atop the voice coil 32 thus forming a cavity (not shown) in an area defined by the diaphragm 16, voice coil 32 and pole piece 30 without a dust cap 44. The term "dust cap cavity" as used herein is therefore also intended to apply to such cavity where the dust cap 44 is removed.

Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker, comprising:

a motor structure including a pole piece formed with a throughbore having an upper end and a lower end which is open to atmosphere, and a voice coil including a former having a hollow interior forming an interior surface and an outer surface which mounts a wire winding, said voice coil being concentrically disposed about and axially movable relative to said pole piece;

a frame having an upper end and a lower end, said lower end being connected to said motor structure;

an upper suspension connected to said upper end of said frame and a diaphragm connected between said upper suspension and said voice coil, a cavity being formed in an area at least partially defined by said diaphragm and overlying said pole piece and said voice coil;

an air flow control device overlying said upper end of said throughbore of said pole piece, a flow path being formed for the passage of air in and out of said cavity which extends in a first direction from said lower end of said throughbore in said pole piece, through said throughbore into said hollow interior of said former and then into said cavity, and which extends in a second direction out of said cavity into said hollow interior of said former and then into said throughbore of said pole piece, said air flow control device being formed with a deflector which is effective to direct air moving along said flow path in both said first direction and said second direction toward said interior surface of said former.

2. The loudspeaker of claim 1 in which said air flow control device is insertable within said throughbore of said pole piece and said deflector is located externally of said throughbore.

3. The loudspeaker of claim 1 in which said air flow control device includes a head portion connected to a body portion, said body portion being formed with a throughbore and at least one transverse bore oriented substantially perpendicular to said throughbore, said body portion being insertable within said throughbore of said pole piece so that said head portion and said at least one transverse bore are located externally of said pole piece.

4. The loudspeaker of claim 3 in which said head portion of said flow control device comprises an annular plate having a diameter smaller than said diameter of said hollow interior of said former.

5. The loudspeaker of claim 1 in which said air flow control device includes a head portion connected to a body portion, said body portion being formed with a number of vanes each having an inner edge and an outer edge, said vanes being interconnected to one another along said inner edge thereof and extending radially outwardly so that a channel is formed between adjacent vanes, said body portion being insertable with said throughbore of said pole piece so that said head portion and at least a portion of each of said channels are located externally of said pole piece.

6. The loudspeaker of claim 5 in which said outer edges of said vanes of said body portion of said air flow control device engage said pole piece within said throughbore thereof.

7. The loudspeaker of claim 5 in which said head portion of said flow control device comprises a circular plate having a diameter less than said diameter of said hollow interior of said former.

8. The loudspeaker of claim 1 in which said air flow control device includes a head portion connected to a body portion, said head portion having an outer edge and being formed with a number of circumferentially-spaced channels extending radially inwardly from said outer edge thereof, said body portion being formed with a number of vanes each having an inner edge and an outer edge, said vanes being interconnected to one another along said inner edge thereof and extending radially outwardly therefrom so that a channel is formed between adjacent vanes, said body portion being insertable within said throughbore of said pole piece so that said head portion and at least a portion of each of said channels are located externally of said pole piece.

9. The loudspeaker of claim 8 in which said head portion of said flow control device comprises an annular plate having a diameter less than said diameter of said hollow interior of said former.

10. The loudspeaker of claim 1 in which said air flow control device includes a base with opposed first and second sides, a cylindrical wall connected to and extending outwardly from said first side of said base and a number of spaced ribs mounted to and extending outwardly from said second side of said base, said ribs being affixed to said pole piece in position to overlie said throughbore thereof thus forming passages defined by said base, said space between adjacent ribs and said pole piece.

11. A loudspeaker comprising:

a motor structure including a pole piece formed with a throughbore open to atmosphere, and a voice coil including a former having a hollow interior forming interior an interior surface and an outer surface which mounts a wire winding, said voice coil being concentrically disposed about and axially movable relative to said pole piece;

a frame having an upper end and a lower end, said lower end being connected to said motor structure;

an upper suspension connected to said upper end of said frame and a diaphragm connected between said upper suspension and said voice coil, a cavity being formed in an area at least partially defined by said diaphragm and overlying said pole piece and said voice coil;

an air flow control device including a head portion connected to a body portion, said body portion being formed with a throughbore and at least one transverse bore intersecting said throughbore, said body portion being insertable within said throughbore of said pole piece so that said head portion and said at least one transverse bore are located externally of said pole piece, said head portion being effective to deflect a flow of air entering and leaving said cavity through said throughbore in said pole piece at least into proximity with said interior surface of said former of said voice coil.

12. A loudspeaker, comprising:

a motor structure including a pole piece formed with a throughbore open to atmosphere, and a voice coil including a former having a hollow interior forming an interior surface and an outer surface which mounts a wire winding, said voice coil being concentrically disposed about and axially movable relative to said pole piece;

a frame having an upper end and a lower end, said lower end being connected to said motor structure;

an upper suspension connected to said upper end of said frame and a diaphragm connected between said upper suspension and said voice coil, a cavity being formed in an area at least partially defined by such diaphragm and overlying said pole piece and said voice coil;

an air flow control device including a head portion connected to a body portion, said body portion being formed with a number of vanes each having an inner edge and an outer edge, said vanes being interconnected along said inner edge thereof and extending radially outwardly from one another so that a channel is formed between adjacent vanes, said body portion being insertable with said throughbore of said pole piece so that said head portion and at least a part of each of said channels are located externally of said pole piece, said head portion being effective to deflect a flow of air entering and leaving said cavity through said throughbore of said pole piece into proximity with said interior surface of said former of said voice coil.

13. The loudspeaker of claim 12 in which said outer edges of said vanes of said body portion of said air flow control device engage said pole piece within said throughbore.

14. The loudspeaker of claim 12 in which said head portion of said flow control device comprises an annular plate having a diameter less than said diameter of said interior surface of said former.

15. A loudspeaker, comprising:

a motor structure including a pole piece formed with a central throughbore open to atmosphere, and a voice coil including a former having a hollow interior forming an interior surface and an outer surface which mounts a wire winding, said voice coil being concentrically disposed about and axially movable relative to said pole piece;

a frame having an upper end and a lower end, said lower end being connected to said motor structure;

an upper suspension connected to said upper end of said frame and a diaphragm connected between said upper suspension and said voice coil, a cavity being formed in an area at least as partially defined by said diaphragm and overlying said pole piece and said voice coil;

an air flow control device including a head portion connected to a body portion, said head portion having an outer edge and being formed with a number of circumferentially-spaced channels extending radially inwardly from said outer edge thereof, said body portion being formed with a number of vanes each having an inner edge and an outer edge, said vanes being interconnected to one another along said inner edge thereof and extending radially outwardly from one another so that a channel is formed between adjacent vanes, said body portion being insertable within said central throughbore of said pole piece so that said head portion and at least a part of each of said channels are located externally of said pole piece, said head portion being effective to deflect a flow of air entering and leaving said cavity through said throughbore of said pole piece into proximity with said interior surface of said voice coil.

16. The loudspeaker of claim 15 in which said head portion of said flow control device comprises an annular plate having a diameter which is smaller than said diameter of said hollow interior of said former.

17. A loudspeaker comprising:

a motor structure including a pole piece formed with a throughbore having a first end and a second end open to atmosphere, and a voice coil including a former having a hollow interior forming an interior surface and an outer surface which mounts a wire winding, said voice coil being concentrically disposed about and axially movable relative to said pole piece;

a frame having an upper end and a lower end, said lower end being connected to said motor structure;

an upper suspension connected to said upper end of said frame and a diaphragm connected between said upper suspension and said voice coil, a cavity being formed in an area at least partially defined by said diaphragm and overlying said pole piece and said voice coil;

an air flow control device having a base with opposed first and second sides, a wall connected to and extending outwardly from said first side of said base and a number of spaced ribs mounted to and extending outwardly from said second side of said base, said air flow control device being mounted to said pole piece in position overlying said first end of said throughbore thus forming passages defined by said base, said space between adjacent ribs and said pole piece, said base and said ribs being effective to contact a flow of air entering and leaving said cavity through said throughbore in said pole piece and to direct said air flow through said passages at least into proximity with said interior surface of said former of said voice coil.

18. The loudspeaker of claim 17 in which said ribs are circumferentially spaced from one another and extend radially outwardly from a central open area along said base which is substantially centered relative to said throughbore in said pole piece.

19. The method of cooling the voice coil of a loudspeaker, comprising:

positioning an air flow control device having a deflector in alignment with the upper end of a throughbore in the pole piece of the loudspeaker motor structure and in communication with a cavity overlying the voice coil and the pole piece;

inducing a flow of air in a first direction into said cavity along a flow path extending from the lower end of said throughbore of said pole piece, through said throughbore into the hollow interior of the former of the voice coil and then into said cavity;

inducing a flow of air in a second direction out of said cavity along said flow path extending from said cavity into said hollow interior of said former of said voice coil and then into said throughbore of said pole piece;

deflecting said flow of air into proximity with at least a portion of the interior surface of the former of said voice coil as a result of contact of said air flow with said deflector of said air flow control device in the course of movement of the air in said first direction into said cavity and in said second direction out of said cavity.

20. The method of claim 19 in which said step of positioning said air flow control device comprises inserting a body portion of the air flow control device within said throughbore of said pole piece so that a head portion of said air flow control device is located externally of said pole piece.

21. The method of claim 20 in which said step of inducing a flow of air includes inducing a flow of air into and out of said cavity along a flow path defined by said throughbore in said pole piece and at least one channel formed in said body portion of said air flow control device.

22. The method of claim 20 in which said step of deflecting said flow of air comprises contacting said flow of air with said head portion of said air flow control device so that said flow of air moves into proximity with at least a portion of said interior surface of said former of said voice coil.

23. The method of claim 19 in which said step of positioning said air flow control device comprises affixing spaced ribs connected to the base of said air flow control device to one end of said pole piece in overlying relation to said throughbore in said pole piece.

24. The method of claim 23 in which said step of deflecting said flow of air comprises directing said flow of air along passages formed between adjacent ribs mounted on said base of said air flow control device and into proximity with at lest a portion of said interior surface of the former of said voice coil.

* * * * *